United States Patent [19]

D'Aragon

[11] 4,112,642

[45] Sep. 12, 1978

[54] INSULATING INSTALLATION FOR A WINDOW FRAME

[76] Inventor: Paul D'Aragon, 21 St-Jacques St., St-Sauveur des Monts, Quebec, Canada

[21] Appl. No.: 792,498

[22] Filed: May 2, 1977

[51] Int. Cl.[2] ..... E06B 3/26

[52] U.S. Cl. ..... 52/202; 52/208; 52/403; 52/304

[58] Field of Search ..... 52/202, 203, 208, 397, 52/398, 304, 616, 403; 160/354; 49/501, 61

[56] References Cited

U.S. PATENT DOCUMENTS

| | | | |
|---|---|---|---|
| 1,592,408 | 7/1926 | Zahner | 52/213 |
| 1,605,583 | 11/1926 | Heymer | 52/202 |
| 2,080,394 | 5/1927 | Ballantyne | 160/354 |
| 3,251,399 | 5/1966 | Grossman | 160/354 |
| 3,668,808 | 6/1972 | Perina | 52/DIG. 13 |
| 4,028,855 | 6/1977 | Prewer | 52/DIG. 13 |

*Primary Examiner*—James L. Ridgill, Jr.
*Attorney, Agent, or Firm*—Larson, Taylor and Hinds

[57] ABSTRACT

A temporary transparent insulating installation is disclosed for mounting on the inside of a window frame. This installation provides for increased insulation of buildings without necessitating an increased number of glazings in a window. The installation comprises a clear plastic sheet with a length greater than the height of the window frame, having a first connecting strip along a top edge. The sheet has side edges with sealing means adapted to seal with two side surfaces of the window frame. The second connecting strip is permanently attached to the top surface of the window frame and is adapted to mate with the first connecting strip along the top edge of the plastic sheet. At least one weight is provided to hold down the plastic sheet on the bottom surface of the window frame. In another installation two or more clear plastic sheets can be hung in a window frame.

7 Claims, 6 Drawing Figures

INSULATING INSTALLATION FOR A WINDOW FRAME

This invention relates to the insulation of windows. More specifically, this invention relates to an easily installable installation for insulating windows and the like.

With present day fuel shortages and increased cost of heating, it has become more imperative to improve the insulation in houses, apartment blocks, office buildings and the like in order to save energy. Whereas walls and roofs may have increased insulation it is not so easy to increase the insulation of a window without increasing the number of glazings. Two glazings are normal for window frames in most insulated houses, and to increase the number of glazings beyond this increases the thickness of the window assembly to a point where it becomes bulky. Additional glazings are also expensive.

It is an object of the present invention to provide a cheap, economical way of installing additional insulation in an existing window frame.

The concept of producing a plurality of air pockets is disclosed in this invention. These air pockets are produced by the installation of at least one clear plastic sheet within the outside glazing of a window frame and preferably within the outside and the inside glazings of a window frame. The plastic sheet is hung in a plane parallel to the glazings. These additional pockets of air produced by the plastic sheet, prevent air circulating between the two glazings or in the case of one glazing prevent the air circulating close to the glass and this in turn contributes to the loss of heat through the window. Further embodiments include at least two plastic sheets hung side by side to prevent the flow of air and to produce further air pockets. Also disclosed is the easy manner in which the plastic sheets may be hung during the winter season and removed during the summer season. The installation of the sheets allows for adjustments to be made at any time to remove any creases or wrinkles that may occur due to expansion or contraction. This adjustable feature is clearly an advance in the art. In the past plastic sheets were generally stapled or nailed to a frame and if creases occurred, the staples or nails had to be removed and the sheet repositioned.

The present invention provides a temporary transparent insulating installation for mounting on the inside of at least one glazing of a window frame with a top surface, bottom surface, and two side surfaces, the installation comprising, a clear plastic sheet having a length greater than the height of the window and having a first connecting strip along a top edge, the sheet having side edges with sealing means adapted to seal with the two side surfaces of the window frame, a second connecting strip permanently attached to the top surface of the window frame adapted to mate with the first connecting strip along the top edge of the plastic sheet, and at least one weight adapted to hold down the plastic sheet on the bottom surface of the window frame.

In drawings which illustrate embodiments of the invention,

Figure 1:
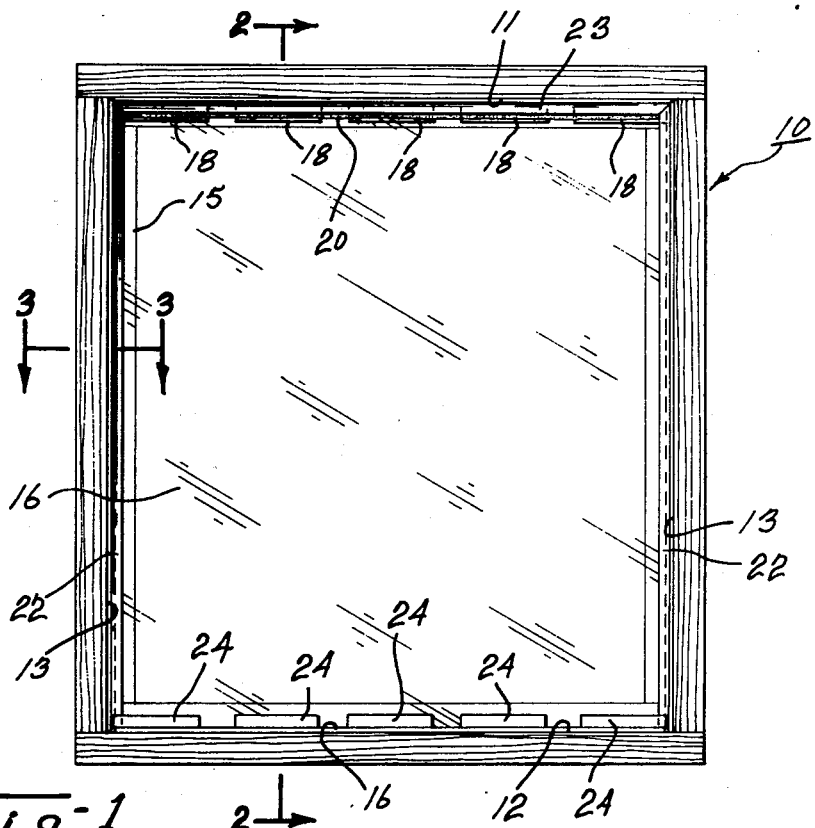
FIG. 1 is an elevation of a window frame showing one embodiment of an insulating installation of the present invention.

Referring now to the drawings, a rectangular window frame 10 is shown in FIG. 1 having a top inside surface 11, a bottom inside surface 12 and two side inside surfaces 13. The window frame 10 may be formed of wood, metal, plastic or other suitable material. As may be seen in FIG. 2 an outside glazing 14 is shown between the top surface 11 and the bottom surface 12 having a retaining section 15. The window frame 10 is illustrated as one example of an existing frame. The window frame does not form part of the present invention and may be of any known shape or design provided it has the inside surfaces described herein. On the inside of the glazing 14 is positioned a clear plastic sheet 16 as a transparent insulating barrier to form an air pocket 17 between the glazing 14 and the plastic sheet 16.

Figure 2:
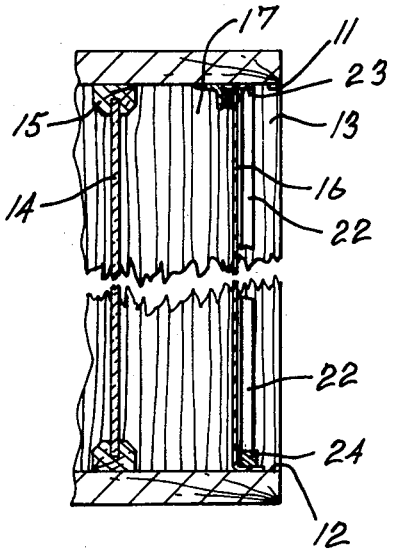
FIG. 2 is a cross sectional elevation at line 2—2 of FIG. 1.
Figure 3:
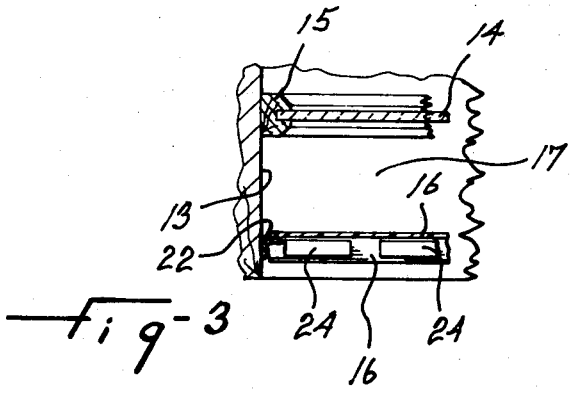
FIG. 3 is a partial cross sectional plan at line 3—3 of FIG. 1.

As may be seen in FIGS. 1 and 2 five angular supports 18 are positioned in line along the top surface 11 of the window frame 10. The angular supports 18 are positioned so that a vertical face is directed towards the inside of the window frame 10. Machine screws 19 hold these angular supports 18 to the top surface 11 of the window frame 10. The clear plastic sheet 16 is preferably made of polyethylene and has along its top edge, a first connecting strip 20 firmly joined thereto by means of an adhesive. The first connecting strip 20 is formed of nylon filament hooks or loops such as the material known under the trade mark Velcro. A second connecting strip 21 which is the mating strip, hooks to mate with loops, or vice versa is joined to the vertical surface of the angular supports 18 by means of an adhesive. This second connecting strip 21 is formed in five sections, each section being joined to an individual angular support 18.

The plastic sheet 16 is slightly narrower than the width of the window frame 10. In order to obtain a proper seal at each side of this plastic sheet, side flexible strips 22 made out of an elastic material such as rubber or resilient plastic are adhesively attached to each side of the plastic sheet 16 so that they form into an L-configuration with one leg resting against the two side surfaces 13 when the plastic sheet 16 is installed. Thus a seal is formed to prevent air passing around the sides of the plastic sheet 16. A top flexible strip 23 is connected along the top edge of the plastic sheet 16 on the opposite side to the first connecting strip 20. This top flexible strip 23 also forms an L-configuration with one leg pressing against the top surface of the window frame 10. The side flexible strips 22 and the top flexible strip 23 are all located on the inside surface of the plastic sheet 16. If the plastic sheet contracts or expands due to changes in temperature or humidity the flexible strips take up this difference in width and prevent the sheet 16 from stretching but still retain a seal at the side and top surfaces. The plastic sheet 16 is somewhat longer than the height of the window frame 10. The bottom end of the plastic sheet 16 is turned inwards to form an L-shaped configuration and a series of weights 24 are placed on this turned in leg. The weights 24 are arranged so that there are no wrinkles or creases existing in the plastic sheet and are sufficiently heavy to ensure that local movement of air within a room does not allow the plastic sheet 16 to come free and commence flapping. Furthermore, if any wrinkles do occur in the plastic sheet 16 then by rearranging the weights 24 the wrinkles may be removed. In another embodiment, if one wishes to remove the plastic sheet 16 temporarily then these weights 24 may be lifted from the bottom of the sheets 16 and the bottom of the sheet lifted up and temporarily tied up or taped up to allow air to pass through the window frame.

Figure 4:
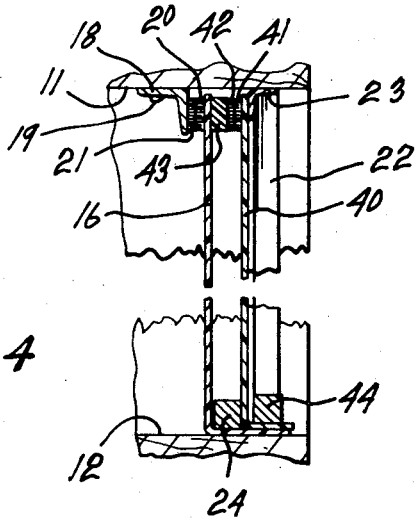
FIG. 4 is a cross sectional elevation of a window frame showing embodiment of the present invention with two plastic sheets.

Another embodiment is shown in FIG. 4 wherein a second plastic sheet 40 hangs inside the first plastic sheet 16. The second plastic sheet 40 has a Velcro strip 41 attached adhesively to the top edge of the sheet which in turn mates with a second Velcro strip 42 adhesively attached to a spacer 43 attached to the first sheet 16. In some cases the spacer need not be there, however, it has been found advantageous to have a space between the first sheet 16 and the second sheet 40 of at least ½ inch as this provides a larger air pocket and increases the insulating properties of the installation. A second series of weights 44 is provided for the bottom end of the second sheet 40 which rests on top of the turned in leg of the first sheet 16.

Figure 5:
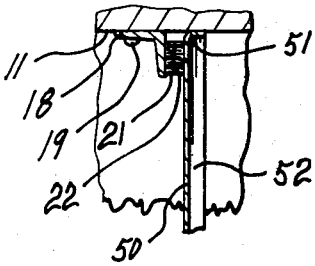
FIG. 5 is a partial cross sectional elevation of a window frame showing a further embodiment of the present invention with the plastic sheet curled up against the top surface of the frame.

In some cases it has been found that there is no need to fit flexible strips to the top and sides of the plastic sheet. FIG. 5 shows a plastic sheet 50 which has a curl 51 at the top to form a seal and prevent air passing across the top of the plastic sheet. The plastic sheet 50 is wider than the width of the window frame and thus forms a curl 52 at each side to act as a seal.

Figure 6:
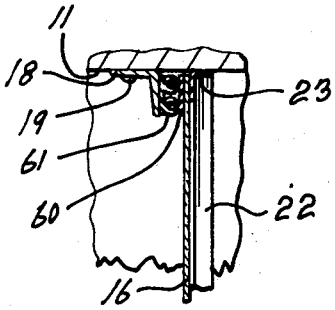
FIG. 6 is a partial cross sectional elevation of a window frame showing a still further embodiment of the present invention with a tongue and groove connecting means between the plastic sheet and an angular support.

FIG. 6 shows another embodiment wherein the first connecting strip 60 at the top of the plastic sheet 16 is a double row of interlocking tongue and groove which mates with the second connecting strip 61. The tongue portion is attached to one strip and the groove portion to the other strip. When the tongue interlocks into the groove, it is held in the groove and requires a firm pull before releasing. This arrangement of tongue and interlocking groove is sold commercially under the trade mark Zip Lock.

It will be apparent to those skilled in the art that a number of changes may be made to the insulating installation shown in the attached drawings and described herein without departing from the scope of the present invention. For instance, it has been described that the first and second connecting strips are adhesively joined to the angular supports and the top of the plastic panel. It will be apparent that this join may be made by stapling, stitching or any other suitable means. Furthermore, Velcro and Zip Lock connecting strips are but two of many different types of connecting strips that could be used. The important point being that whatever the type of connecting strips, the plastic sheet can be removed easily at the end of a winter season and the sheet rolled up until the following year. Whereas an angular support is shown in the drawings, it will be apparent that this could be a support formed from wood having a rectangular or square cross section or even a quarter round cross section which could be glued or tacked to the top surface of the frame. Other changes may be made to the details of the present embodiments without departing from the scope of the present claims.

The embodiments of the invention in which an exclusive property of privilege is claimed are defined as follows:

1. A temporary transparent insulating installation for mounting on the inside of at least one glazing of a window frame with a top surface, bottom surface, and two side surfaces, the installation comprising a clear plastic sheet having a length greater than the height of the window frame, and a width slightly less than the width of the window frame, and having a first connecting strip along a top edge, the sheet having flexible and elastic sealing means adapted to seal with two side surfaces and top surface of the window frame, said sealing means comprising a strip of flexible and elastic material attached at the side and top edges of the sheet and which, when said installation is mounted on a window frame, bends into a substantially L-shaped configuration with one leg pressing directly against the respective side surfaces and top surface of the window frame, such that the flexible strips take up differences in width due to contraction or expansion of the plastic sheet, a second sheet connecting strip permanently attached to the top surface of the window frame, adapted to provide an immovable mating connection with the first connecting strip along the top edge of the plastic sheet, and at least one weight adapted to hold down the plastic sheet on the bottom surface of the window frame, forming a substantially L-shaped configuration such that rearrangement of the holding weight can be made to remove wrinkles in the plastic sheet.

2. The installation of claim 1 wherein a second clear plastic sheet is mounted adjacent to the first plastic sheet.

3. The installation of claim 2 wherein at least one spacer is located between the first and second plastic sheet.

4. The installation of claim 1 wherein the second connecting strip comprises a plurality of angular supports each having a vertical surface, the vertical surface of the plurality of the angular supports being in line and adapted to mate with the first connecting strip along the top edge of the plastic sheet.

5. The installation of claim 4 wherein each vertical surface of the plurality of angular supports has a plurality of nylon filament hooks thereon and wherein the first connecting strip has a plurality of nylon filament loops thereon adapted to mate with the nylon filament hooks.

6. The installation of claim 4 wherein each vertical surface of the plurality of angular supports has a plurality of nylon filament loops thereon, and wherein the first connecting strip has a plurality of nylon filament hooks thereon adapted to mate with the nylon filament loops.

7. The installation of claim 4 wherein the vertical surface of the plurality of angular supports has at least one groove or interlocking tongue adapted to mate with a mating interlocking tongue or groove of the first connecting strip along the top edge of the plastic sheet.

* * * * *